United States Patent [19]

Bai et al.

[11] Patent Number: 4,756,254

[45] Date of Patent: Jul. 12, 1988

[54] PENETRATING PROJECTILE

[75] Inventors: Monty W. Bai, Scottsdale; Louis P. Farace, Mesa; John D. Titus, Phoenix, all of Ariz.

[73] Assignee: Motorola, Inc., Schaumburg, Ill.

[21] Appl. No.: 866,860

[22] Filed: May 27, 1986

[51] Int. Cl.[4] ..... F42B 11/20

[52] U.S. Cl. ..... 102/511; 102/214; 102/517

[58] Field of Search ..... 102/501, 511, 517–519, 102/506, 211–214, 293, 270, 271; 89/6, 6.5

[56] References Cited

U.S. PATENT DOCUMENTS

| | | | |
|---|---|---|---|
| 623,707 | 4/1899 | Dittmar | 102/518 |
| 841,753 | 1/1907 | Wheeler et al. | 102/519 |
| 1,089,161 | 3/1914 | Shore | 102/518 |
| 1,223,634 | 4/1917 | Steinmetz | 102/518 |
| 2,928,348 | 3/1960 | Zisman et al. | 102/511 X |
| 2,962,967 | 12/1960 | Bixby | 102/214 |
| 2,990,777 | 7/1961 | Garman | 102/214 |
| 3,269,315 | 8/1966 | Gauld . | |
| 4,044,679 | 8/1977 | Pagano et al. . | |
| 4,136,616 | 1/1979 | Schineker . | |
| 4,237,787 | 12/1980 | Wecula et al. . | |
| 4,280,408 | 7/1981 | Weber et al. . | |
| 4,516,502 | 5/1985 | Klein et al. . | |

*Primary Examiner*—Harold J. Tudor

*Attorney, Agent, or Firm*—Maurice J. Jones; Eugene A. Parsons

[57] ABSTRACT

A projectile having a piercing front end with a solid lubricant molded on the front surface for reducing friction during penetration. The lubricant is molded in a shape to receive an antenna and other electronics. The front end also has an axial hole formed therein to enhance self destruction from the sudden release of compressional strain energy accumulated during penetration through a hard target.

13 Claims, 2 Drawing Sheets

PENETRATING PROJECTILE

BACKGROUND OF THE INVENTION

In the armor penetrating projectile art a variety of different problems have arisen, all of which occur because the armor penetrating projectile must have a front end formed of high strength steel or the like, sufficiently hard to penetrate armor, which makes it extremely difficult to mount additional components thereon. In many other applications a penetrator is designed to pass through thick and/or relatively hard defenses so that a similar problem, i.e. mounting additional components thereon, is prevalant. Further, the preferred configuration of the penetrator front end is an ogive with a well-known mass distribution, i.e. the higher the mass at the nose the more effective the penetrator, while ideal ballistic characteristics may require a somewhat different shape and mass distribution. Also, in many applications a shaped charge is carried within the projectile and after the front end has penetrated a target it is desirable for the front end to be eliminated so that the shape charge can be detonated within the target.

SUMMARY OF THE INVENTION

The present invention pertains to a penetrating projectile having a piercing front end with a coating of solid lubricant affixed to the front surface thereof. The coating may be formed with steps and threads therein to attach antennas and other electronic components thereto. Further, the coating and other components are formed to improve the ballistic characteristics of the projectile. Also, the piercing front end may be formed with an axial hole extending partially or completely therethrough to enhance self destruction due to a sudden release of compressional strain energy accumulated during hard target penetration.

It is an object of the present invention to provide a new and improved penetrating projectile.

It is a further object of the present invention to provide a new and improved penetrating projectile which includes a coating of solid lubricant on the front surface for reducing friction during penetration into a target.

It is a further object of the present invention to provide a new and improved penetrating projectile constructed for the convenient mounting of external electronic components.

It is a further object of the present invention to provide a penetrating projectile which self destructs after penetration of a hard target.

These and other objects of this invention will become apparent to those skilled in the art upon consideration of the accompanying specification, claims, and drawings.

BRIEF DESCRIPTION OF THE DRAWINGS

Referring to the drawings.

DESCRIPTION OF THE PREFERRED EMBODIMENT

Figure 1:
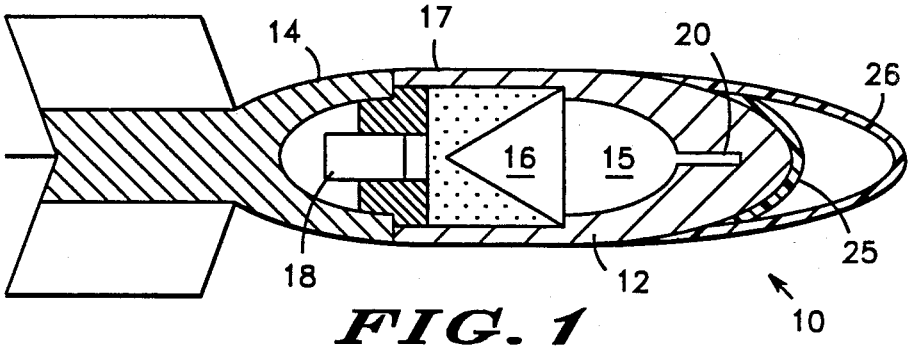
FIG. 1 is a sectional view of a penetrating projectile embodying the present invention.

Referring specifically to FIG. 1, a penetrating projectile generally designated 10 is illustrated. Projectile 10 includes a cylindrical body 12 and a guidance or tail assembly 14. Body 12 and tail assembly 14 define a central cavity 15 designed to carry the payload of the projectile 10. In this specific application cavity 15 has a shape charge 16 fixedly positioned therein against a rear wall 17. A detonating device 18 is mounted in an opening through rear wall 17 so as to be in communication with shape charge 16. Detonating device 18 may be any of a large variety of devices utilized to detonate projectiles, one example of which is disclosed in a pending U.S. Patent application entitled "Fuze Actuating System Having a Variable Impact Delay", Ser. No. 402,389, filed July 27, 1982, and assigned to the same assignee. In this particular detonating system detonation occurs at a time after impact has occurred.

Body 12 has a front end with a generally arcuate front surface generally referred to in the art as an ogive. In this specific embodiment the front end and remainder of the body 12 are constructed in one piece to eliminate the structural weaknesses at joints and the like. Body 12 is formed of high strength steel which is locally heat treated at the front surface and to a predetermined depth beneath the front surface to increase the hardness of the body 12 and penetration ability, without losing its ductility. For example, if the entire body 12 were completely heat treated it would become brittle and would simply break upon striking a hard target. By locally heat treating only the material adjacent the front surface the hardness is increased while not substantially reducing the ductility. The front end of body 12 also defines a hole 20 extending axially forward from cavity 15 toward the tip of projectile 10. Body 12 is a self destructive kinetic energy penetrator designed to be destroyed due to a sudden release of compressional strain energy accumulated in the front end of body 12 just after hard target penetration. Hole 20 enhances this self destructive feature by essentially incorporating a weakness that enhances the tearing apart of the front end of body 12. This tearing apart of body 12 is illustrated in FIGS. 2A–D.

Figure 2A:
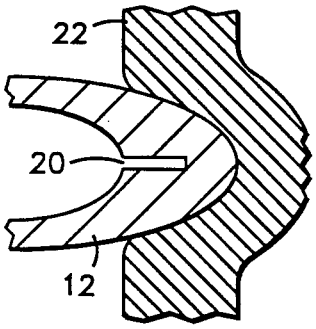
FIGS. 2A–D are sectional views, portions thereof removed, of the projectile of FIG. 1 penetrating a hard target.
Figure 2B:
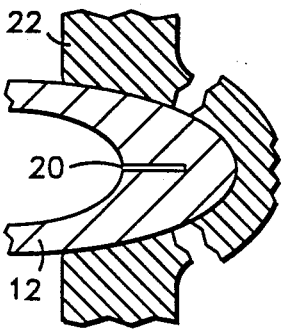
Figure 2C:
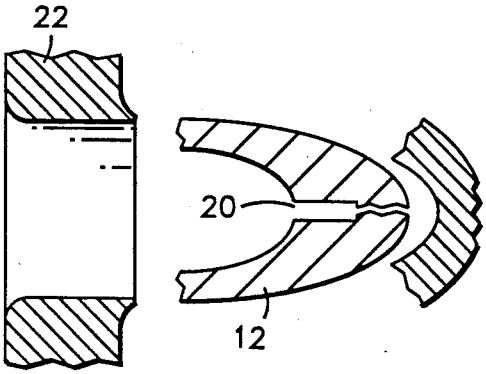
Figure 2D:
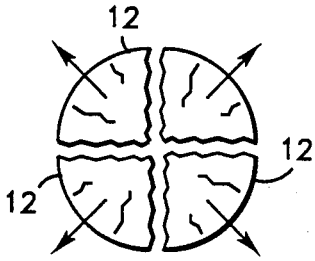

FIG. 2A illustrates the front end of body 12 penetrating a hard target, such as a wall 22. As the front end of body 12 penetrates wall 22 there is a compressional force on body 12, as illustrated in FIG. 2B. As body 12 passes through wall 22 there is a sudden release of the compressional strain energy and body 12 tends to rapidly expand. The rapid expansion produces a tearing of body 12 from hole 20, as illustrated in FIGS. 2C and 2D. The self destruction of the front end of body 12 greatly enhances the destructive force of projectile 10, since shape charge 16, which is now inside of the target is free to explode into the target with literally no obstructions.

In addition to the self destruct feature projectile 10 has a coating 25 on the front surface of the body 12 of solid lubricant material such as tetrafluoroethylene resin. The solid lubricant coating can also contain some powdered metal, such as lead or graphite, to enhance lubrication. Coating 25 may be laminated, molded, molded and glued, etc. onto the front surface of body 12. The solid lubricant material is applied to the front surface of body 12 to reduce friction during penetration into a target. A wind shield 26 is positioned over the front end of body 12 and solid lubricant coating 25 to protect the lubricant material during flight of the projectile. Wind shield 26 is also constructed to adjust/improve the ballistic characteristics of projectile 10. Thus, body 12 can be constructed for optimum penetration and any deficiencies in the ballistic characteristics can be improved or adjusted by wind shield 26. Wind shield 26 is of course destroyed upon impact leaving solid lubricant coating 25 to enhance penetration of body 12.

Figure 3:
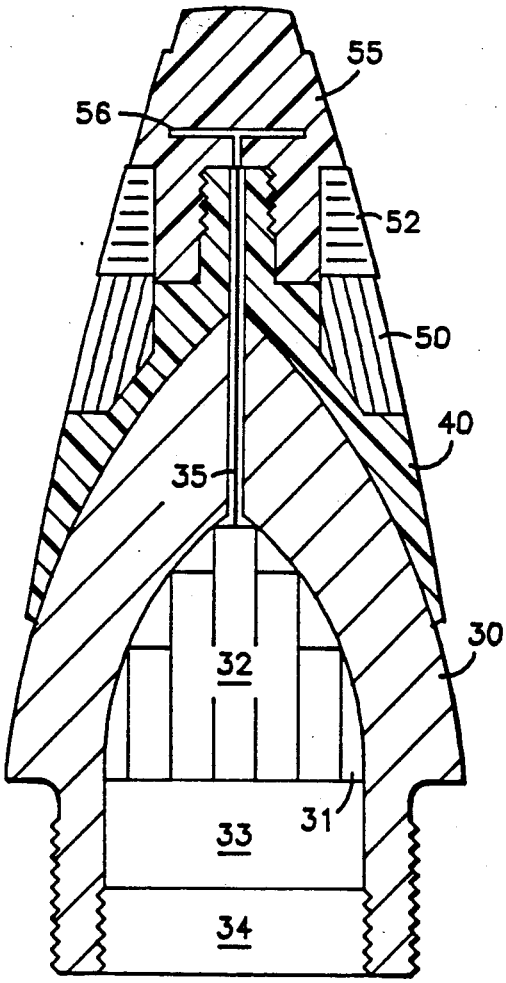
FIG. 3 is a sectional view of a portion of another penetrating projectile embodying the present invention.
Figure 4:
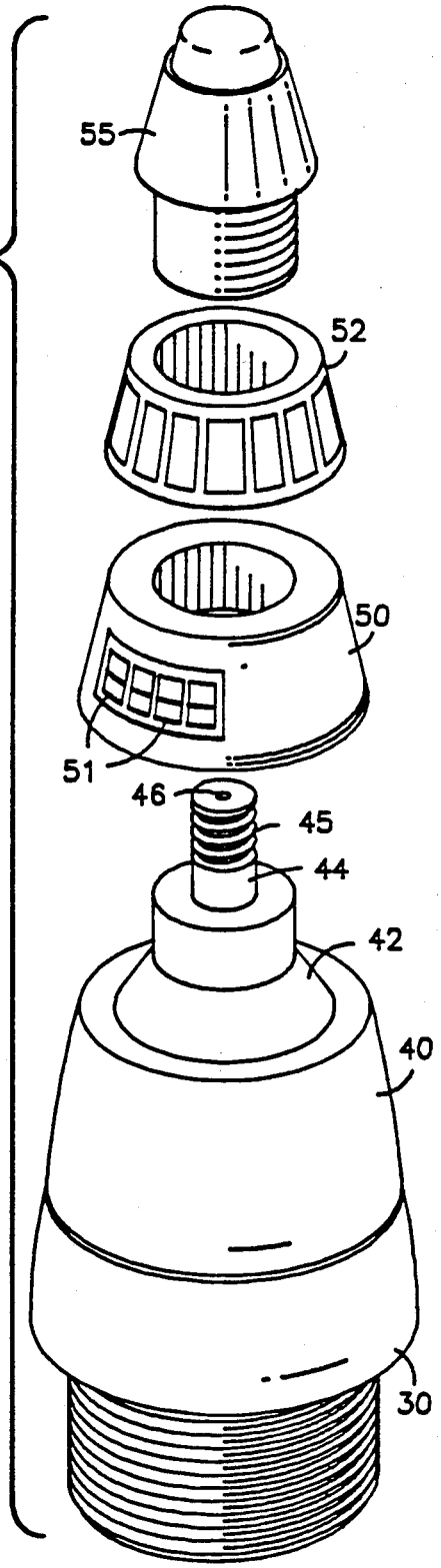
FIG. 4 is an exploded view in perspective of the portion of the penetrating projectile illustrated in FIG. 3.

Referring specifically to FIGS. 3 and 4, a second armor penetrating projectile embodying the present invention is illustrated. FIGS. 3 and 4 illustrate only a front end portion of a projectile, which front end portion is designed to threadedly engage the remainder of the projectile. Front end portion 30 defines a central cavity 31 containing, for example, an electronics package 32 including a transceiver, logic, and various sensors, a reserve battery 33 and a mechanical safing and arming device 34. Front end portion 30 also defines an axially extending hole 35 passing through the front end portion 30 from cavity 31. A solid lubricant coating 40 is molded on the front surface of front end portion 30 in fixed mating engagement therewith. Coating 40 may be, for example, formed of tetrafluoroethylene resin or other material which will operate as a lubricant under the high pressure and temperature conditions of the projectile impact. Also, in some instances additional material, such as adhesive may be required to fixedly engage coating 40 onto the front surface of front end portion 30. It will be understood by those skilled in the art that even materials considered to be adhesive may operate as a lubricant during the penetration of front end portion 30 into a hard target.

In the present embodiment coating 40 is formed with a radially inwardly stepped portion 42 and a smaller cylindrical portion 44 which extends axially forward and includes threads 45 formed in the outer surface thereof. Coating 40 is formed with an axial opening 46 therethrough, which opening is coaxially aligned with opening 35 through front end portion 30. A ring shaped control member 50 is formed to fit coaxially over stepped portion 42 of coating 40 and may include, for example, thumb switches 51 utilized to manually set various timing features of the fuze. In this specific embodiment a second ring shaped control member 52 is designed to coaxially mate with ring shaped member 50 and includes one or more wire coils for automatically setting predetermined features of the electronic package 32 upon firing of the projectile. Ring shaped members 50 and 52 may be formed in a single unit or may be formed, as illustrated, in two separate units.

A plastic tip 55 has an axially extending opening therein with internal threads in the surface formed to mate with threads 45 on cylindrical portion 44 of coating 40. Tip 55 extends within ring shaped member 52 and fixedly engages ring shaped member 50 in inwardly stepped portion 42 of coating 40. Also, tip 55 cooperates with ring shaped members 52 and 50 and with a rear portion of coating 40, to form a substantially continuous outer surface, which outer surface is designed to improve the ballistic characteristics of front end portion 30. Tip 55 includes an antenna 56 molded therein and tip 55 is formed of a plastic which is invisible to the transmission and reception frequencies of antenna 56. Antenna 56, the coils in ring shaped member 52 and thumb switches 51 in ring shaped member 50 are all connected with electronics package 32 by way of hole 46 through coating 40 and hole 35 through front end portion 30.

Thus, it can be seen that solid lubricant coating 40 forms a convenient base for mounting various external components thereon, such as antennas and other electronic devices, and the various devices form a wind shield to protect the lubricant material during flight. Also, the various devices and the solid lubricant coating cooperate to adjust/improve the ballistic characteristics of the front end portion 30 of the projectile. Thus, an improved penetrating projectile is disclosed wherein a solid lubricant coating is affixed to the front surface of the penetrator to reduce friction during penetration into a hard target. Further, the solid lubricant may be conveniently used to mount various external components to the penetrator, which components were virtually impossible to attach to previous penetrators. Further, the various external components may be mounted so as to form a wind shield to protect the solder lubricant coating and to improve the ballistic characteristics of the penetrator.

While we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

What is claimed is:

1. A penetrating projectile comprising:

a substantially cylindrical body generally symmetrical about an axis of flight with a piercing front end portion having a generally arcuate front surface, said cylindrical body being further formed to define a central cavity and further defining a hole extending axially from said central cavity through said front end portion;

a generally symmetrical coating of solid lubricant formed on the front surface and fixedly engaged therewith for reducing friction during penetration into a target, said coating being formed to define a radially inwardly stepped portion and a smaller cylindrical portion extending axially forward with threads formed in the outer surface thereof;

a ring shaped control member positioned coaxially over the radially inwardly stepped portion of said coating;

an antenna molded into a plastic tip, said tip being formed with an axially extending opening therein and further being formed with threads in the surface of the opening, which opening and threads are formed to mate with the forwardly extending threaded portion of said coating; and said plastic tip fixedly engaging said ring shaped control member in the radially inwardly stepped portion of said coating when mated with the forwardly extending threaded portion of said coating and said plastic tip further cooperating with said ring shaped control member and said coating to define a substantially continuous and symmetrical front surface.

2. A penetrating projectile as claimed in claim 1 having in addition electronics mounted in the central cavity defined by the cylindrical body, and electrical transmission means connecting the ring shaped control member and the antenna to said electronics through the axially extending hole defined by the cylindrical body.

3. A penetrating projectile as claimed in claim 2 wherein the solid lubricant includes tetrafluoroethylene resin.

4. A penetrating projectile comprising:

a substantially cylindrical body with a piercing front end portion having a generally arcuate front surface;

a coating of solid lubricant on the front surface for reducing friction during penetration into a target, said solid lubricant coating being generally symmetrical about an axis of flight of the projectile and further includes a radially inwardly stepped portion and a cylindrical portion extending axially forward with threads formed in the outer surface thereof;

at least one ring shaped control member positioned coaxially over said radially inwardly stepped portion of said solid lubricant coating; and an internally threaded plastic member containing an antenna and threadedly engaged over said axially forwardly extending portion of said solid lubricant coating, said internally threaded plastic member being formed to improve the ballistic characteristics of the projectile and protect the solid lubricant during flight.

5. A penetrating projectile as claimed in claim 4 wherein the cylindrical body defines an axially extending hole therethrough for the passage of electrical transmission means connecting said control member and said antenna to electronics mounted in the projectile.

6. A penetrating projectile as claimed in claim 4 wherein the solid lubricant coating includes tetrafluoroethylene resin.

7. A penetrating projectile as claimed in claim 4 wherein the cylindrical body is formed of steel locally heat treated at the front surface to increase the hardness without substantially reducing the ductility.

8. A penetrating projectile comprising:

a substantially cylindrical body with a piercing front end portion having a generally arcuate front surface;

a coating of solid lubricant on the front surface for reducing friction during penetration into a target, said solid lubricant coating includes a radially inwardly stepped portion and a cylindrical portion extending axially forward with threads formed in the outer surface thereof;

at least one ring shaped control memeber positioned coaxially over said radially inwardly stepped portion of said solid lubricant coating; and an internally threaded plastic member containing an antenna and threadedly engaged over said axially forwardly extending portion of said solid lubricant coating.

9. A penetrating projectile as claimed in claim 8 wherein the cylindrical body defines an axially extending hole therethrough for the passage of electrical transmission means connecting said control member and said antenna to electronics mounted in the projectile.

10. A penetrating projectile as claimed in claim 8 wherein the solid lubricant coating includes tetrafluoroethylene resin.

11. A penetrating projectile as claimed in claim 8 wherein the solid lubricant coating is generally symmetrical about an axis of flight.

12. A penetrating projectile as claimed in claim 8, said projectile further comprising:

an appartus mounted in front of the coating of said solid lubricant and formed to improve the ballistic characteristics of the projectile and protect the solid lubricant during flight wherein said solid lubricant has a front surface formed to receive the apparatus mounted thereon.

13. A penetrating projectile as claimed in claim 8 wherein the cylindrical body is formed of steel locally heat treated at the front surface to increase the hardness without substantially reducing the ductility.

* * * * *